US006193556B1

(12) United States Patent
Escane

(10) Patent No.: US 6,193,556 B1
(45) Date of Patent: Feb. 27, 2001

(54) ELECTRICAL TERMINAL ARRAY WITH INSULATION DISPLACEMENT CONNECTORS AND SURGE ARRESTORS

(75) Inventor: Richard Escane, Orpington (GB)

(73) Assignee: A. C. Egerton Limited, Kent (GB)

( * ) Notice: Subject to any disclaimer, the term of this patent is extended or adjusted under 35 U.S.C. 154(b) by 0 days.

(21) Appl. No.: 09/040,756

(22) Filed: Mar. 18, 1998

(30) Foreign Application Priority Data

Mar. 19, 1997 (GB) ..... 9705714

(51) Int. Cl.[7] ..... H01R 13/66
(52) U.S. Cl. ..... 439/620; 439/922
(58) Field of Search ..... 439/620, 402, 439/403, 389, 395, 400, 404, 405, 406, 413, 426, 437, 438, 439, 443, 922; 361/117, 118, 119

(56) References Cited

U.S. PATENT DOCUMENTS

| | | | | |
|---|---|---|---|---|
| 4,106,837 | * | 8/1978 | Paluch | 439/403 |
| 4,118,091 | * | 10/1978 | Frisby | 439/101 |
| 4,159,500 | * | 6/1979 | Baumbach et al. | 361/119 |
| 4,272,147 | * | 6/1981 | Berglund et al. | 439/92 |
| 4,647,121 | * | 3/1987 | Dolansky | 439/108 |
| 5,224,881 | | 7/1993 | Lejuste et al. | 439/709 |
| 5,399,099 | * | 3/1995 | Englsih et al. | 439/417 |
| 5,451,170 | * | 9/1995 | Suffi | 439/404 |
| 5,515,436 | * | 5/1996 | Bonvallat | 379/412 |
| 5,573,434 | * | 11/1996 | Ittah et al. | 439/839 |

FOREIGN PATENT DOCUMENTS

| | | |
|---|---|---|
| 0 041 596 | 12/1981 | (EP) . |
| 0 311 263 | 4/1989 | (EP) . |
| 0 643 454 | 3/1995 | (EP) . |
| 0 708 497 A2 | 4/1996 | (EP) . |
| 2 293 699 | 4/1996 | (GB) . |
| WO 93/07654 | 4/1993 | (WO) . |

* cited by examiner

*Primary Examiner*—Paula Bradley
*Assistant Examiner*—Ross Gushi
(74) *Attorney, Agent, or Firm*—Lahive & Cockfield, LLP; Anthony A. Laurentano

(57) ABSTRACT

The application describes an electrical terminal comprising a pair of longitudinally disposed contact members, each having a pair of insulation displacement connectors connectors, one at either end thereof, thereby to link two wire pairs, wherein. each contact member comprises a contact arm each extending in a defined direction, the contact arms leading to a pair of arrestor contacts spaced so as to accept a surge arrestor. The defined direction is preferably substantially transverse to the contact members. This enables the surge arrestor to be placed to one side of the electrical terminal, avoiding interference with ingoing and outgoing wires and avoiding inhibiting access to test points. The contact members are preferably parallel within the electrical terminal. The arrestor contacts are preferably spring contacts, thereby to enable replacement of the arrestor. The contact arms more preferably end at the spring contacts. In a particularly preferred embodiment, the contact arms are non-contiguous with the contact members but are joined thereto. This join can be by way of a lug extending from the edge of one of the two members and engaging within a slot of the other. This provides a particularly simple but effective electrical contact. The lug is preferably on the contact members, thereby placing the slot on the contact arms. This also avoids the need to bend a single-piece blank, thereby risking damage to or distribution of the IDC connector. The terminal will ideally be enclosed within a plastic housing, and this will preferably comprise a recess for receiving the surge arrestor, the arrestor contacts extending into the recess.

13 Claims, 3 Drawing Sheets

ELECTRICAL TERMINAL ARRAY WITH INSULATION DISPLACEMENT CONNECTORS AND SURGE ARRESTORS

TECHNICAL FIELD OF THE INVENTION

The present invention relates to an electrical terminal.

DESCRIPTION OF BACKGROUND ART

In the telecommunications field, it is necessary to create a large number of semi-permanent electrical connections between wire pairs. Such connections are usually made with releasable connectors such as shown in our earlier British Patent applications Nos. GB-A-2293699 and GB-A-2303500. The former shows the arrangement in which such connectors, sold by us under the Trade Mark "Mini Rocker" are arranged, i.e. in parallel strips of ten connectors. It is necessary to arrange the connectors in a compact array such that the entire apparatus does not occupy an excessive volume, in view of the large number of wire pairs to be connected.

Telephone lines are often suspended above ground where they are susceptible to lightning strike. Lines are also at risk of contact with electrical power cables, whether above or below ground. This means that it is often necessary to provide surge protection for telecommunications contacts. Heretofore, our Mini Rocker connectors have been fitted with surge protection as and where necessary by providing a plug-in module above the Mini Rocker array which contains individual surge arrestors and contacts adapted to extend into test access points and make contact with the internal insulation displacement connectors.

SUMMARY OF INVENTION

The present invention seeks to provide a more permanent arrangement of the surge arrestors which does not inhibit access to the test points. Difficulties arise in doing so in that the closely spaced nature of the electrical terminals inhibits the physical room available for the arrestor. Furthermore, a large number of wire pairs needs to be accommodated between the terminals, further inhibiting the dimensional requirements of the terminal.

The present invention therefore provides an electrical terminal comprising a pair of longitudinally disposed contact members, each having a pair of insulation displacement connectors, one at either end thereof, thereby to link two wire pairs, wherein each contact member comprises a contact arm each extending in a defined direction, the contact arms leading to a pair of arrestor contacts spaced so as to accept a surge arrestor.

Preferably, the defined direction is substantially transverse to the contact members. This enables the surge arrestor to be placed to one side of the electrical terminal, avoiding interference with ingoing and outgoing wires and avoiding inhibiting access to test points.

The contact members are preferably parallel within the electrical terminal.

The arrestor contacts are preferably spring contacts, thereby to enable replacement of the arrestor. The contact arms more preferably end at the spring contacts.

In a particularly preferred embodiment, the contact arms are non-unitary with the contact members but are joined thereto. This join can be by way of a lug extending from the edge of one of the two members and engaging within a slot of the other member. This provides a particularly simple but effective electrical contact. The lug is preferably on the contact members, thereby placing the slot on the contact arms. This also avoids the need to bend a single-piece blank, thereby risking damage to or distribution of the insulation displacement connector.

The terminal will ideally be enclosed within a plastics housing, and this will preferably comprise a recess for receiving the surge arrestor, the arrestor contacts extending into the recess.

The above electrical terminals can be arranged in a linear array, in which case there is preferably an earth strip associated with the linear array from which extend a plurality of earth contacts into the recesses of the plastics housings.

In another aspect of the present invention, it provides an electrical terminal comprising a pair of longitudinally disposed contact members, each having a pair of insulation displacement connectors, one at either end thereof, thereby to link two wire pairs, wherein each contact member comprises a contact arm extending in a defined direction and leading to a pair of arrestor contacts spaced so as to accept a surge arrestor, the contact arms being noncontiguous with the contact members but joined thereto.

BRIEF DESCRIPTION OF DRAWINGS

Embodiments of the present invention will now be described by way of example, with reference to the accompanying figures, in which.

DETAILED DESCRIPTION OF PREFERRED EMBODIMENT

Figure 1:
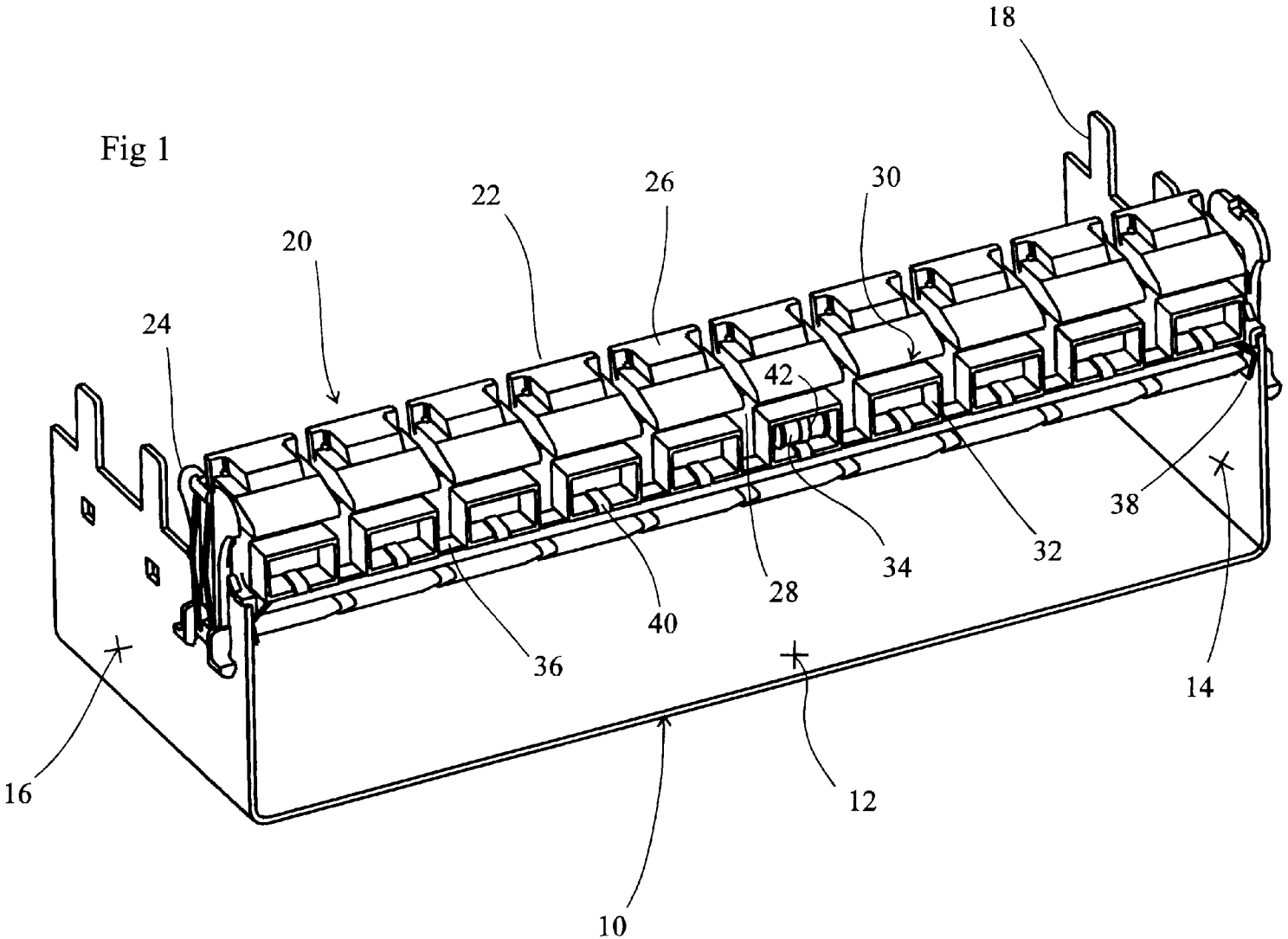
FIG. 1 is a perspective view of an array of ten connectors according to the present invention.

Referring to FIG. 1, this shows a metallic base unit 10 which comprises a floor portion 12 with upstanding parallel walls 14, 16 at either end thereof. Castellations such as shown at 18 extend upwardly from the upper edge of the walls 14, 16. The castellations 18 on the walls 14 and 16 are arranged so as to be in aligned pairs, one on each wall 14, 16. This permits a ten-connector array of terminals to be fitted onto each pair of castellations. Thus, a plurality of such arrays can be arranged in a generally parallel state to form a two dimensional array.

A single such array 20 of ten terminals 22 is shown in FIG. 1. This array 20 is held in place by clips 24 which fit over the castellations 18.

Each terminal 22 comprises a head portion 26 which is attached to a body portion 28 via a hinge line 30 at the rear of the terminal 22. Thus, the head portion 26 can move in a generally vertical direction. A pair of holes (not visible In FIG. 1) are formed on the front face of the head portion 26 and allow access to generally horizontal passageways, suitably sized to accept incoming wires.

At the rear of each connector 22 is a socket 32 suitable sized to receive an arrestor 34. The socket 32 Is integrally formed with the remainder of the plastics body of the terminal 22, and has an open rear face to allow insertion and removal of the arrestor 34. The open rear face also permits visual confirmation of the presence or absence of an arrestor. An earth bar 36 runs along the rear of the array 20 of connectors 22. A pair of spring contacts 38 at either end of the bar 36 provides grounding to the earthed base 10. A plurality of earth contacts 40 extend from the earth bar 36 and into the socket 32 via the open rear face. These earth contacts 40 are positioned so as to make contact with the earth connection 42 of the arrestor 34.

Figure 2:
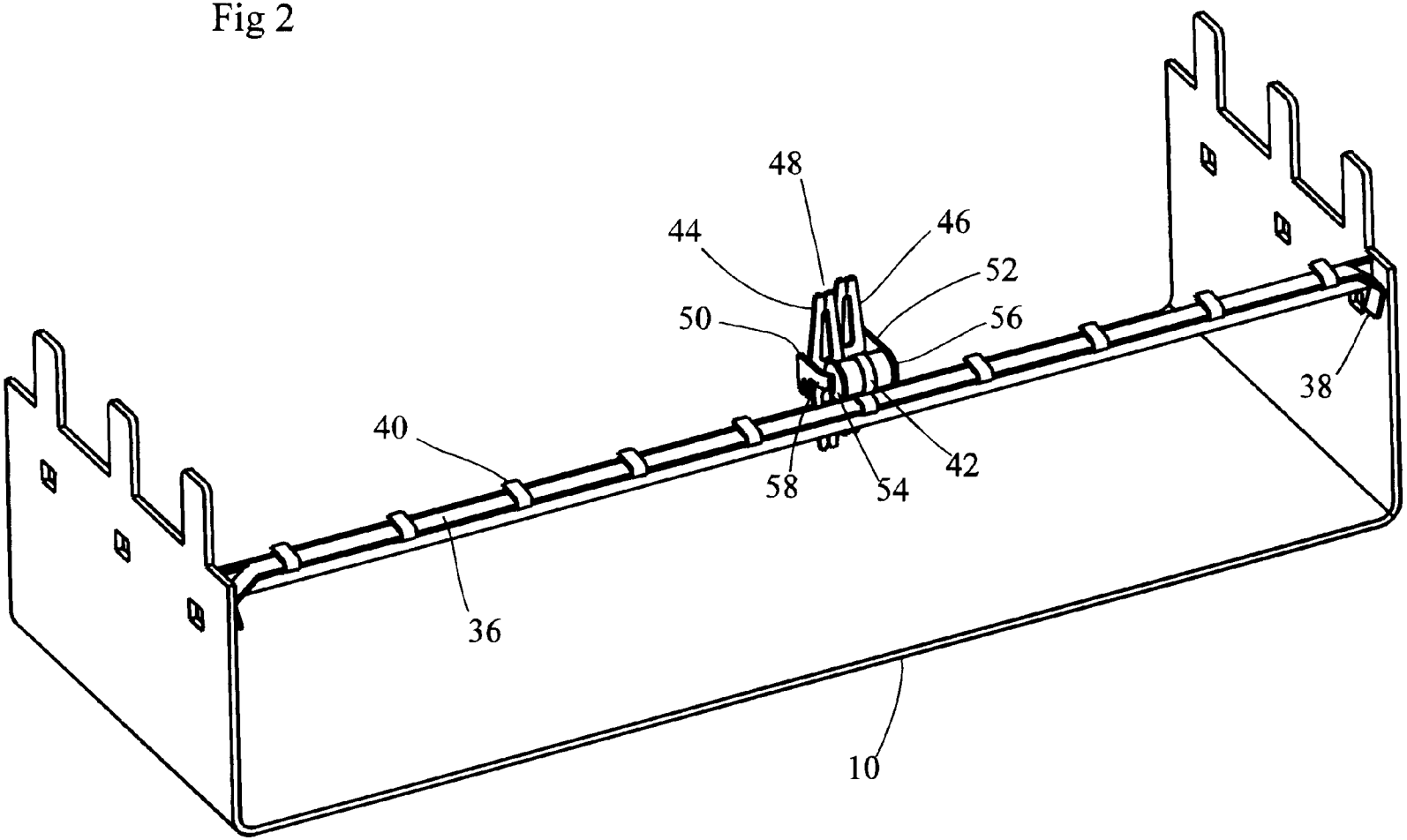
FIG. 2 is a view according to FIG. 1, with the plastics elements removed thereby showing the electrical contacts and surge arrestor only.

FIG. 2 shows the earthing bar 36 and arrestor 34 of FIG. 1 more clearly.

FIG. 2 also shows the insulation displacement connectors 44, 46 within the terminal 22. These each comprise a vertically disposed contact member with an IDC tip such as shown at 48 at either end thereof. The head portion 26 moves, as mentioned before, between a lower position in which the insulation displacement connectors tip 48 projects into the wire-receiving passage and arrays positioned in which the wire receiving passage is clear of the insulation displacement connectors tip 48. Thus, a wire pair can be inserted into the two openings at the front of the connector 22 with the head portion 26 in the raised position. The head portion 26 can then be depressed in a lower position in order to make electrical contact between the wires and the insulation displacement connectors 44, 46.

Similar insulation displacement connectors tips exist at the lower end of the contacts 44, 46. These allow connection with an exchange wire, and are supplied in connected form. A movable head arrangement generally similar to the head portion 26 is provided to facilitate connection (as shown in our application No. GB 2293699).

FIG. 2 shows the contact arms 50, 52 extending from the two contact members 44, 46 alongside the respective inner walls of the body portion 28 (not shown in FIG. 2). These project into the socket 32 and make contact with the contact caps 54,56 of the surge arrestor 34 via spring contacts such as shown at 58.

Figure 3:
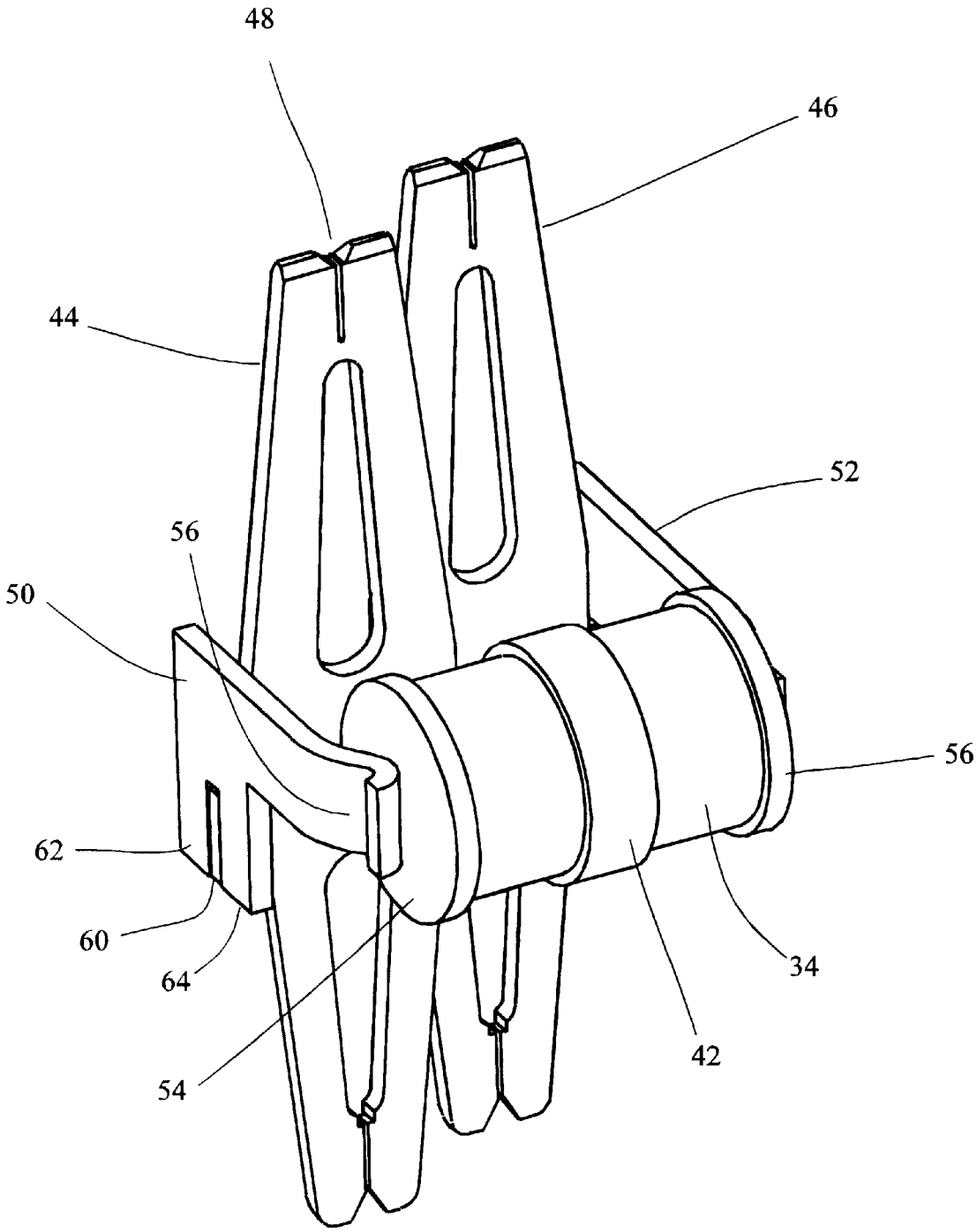
FIG. 3 is an enlarged view of the contacts and surge arrestor of the single terminal.

FIG. 3 shows the relevant parts of FIG. 2 in more detail. It can be seen that the contact member 44 has a small lug 60 extending generally outwardly at roughly its waist portion. Similarly, the contact arm 50 has a pair of downwardly depending lugs 62, 64 which define a gap therebetween into which the lug 60 is an interference fit. This provides an adequate electrical connection whilst allowing ease and reliability of manufacture. Were the contact arms 50 to be formed by bending a one piece blank such that the contact arm 50 extended transversely through the remainder of the insualtion displacement connector, this would result in a significant risk of deformation of the remainder of the insulation displacement connector. This in turn would risk degrading the electrical contact between the exchange and consumer wires. Meanwhile, the positioning of the arrestor 34 permitted by this arrangement maintains it clear of both other connectors 32 and the usual access routes for wires to and from the terminals 22.

It will be appreciated by those skilled in the art that the above described embodiment is by way of example only, and that many variations can be made thereto without departing from the scope of the present invention.

What is claimed is:

1. An electrical terminal for linking two wire pairs, comprising:

a pair of contact members, each having insulation displacement connectors at either end thereof, thereby to enable two wire pairs to be linked, wherein each contact member of said pair of contact members includes a contact arm, the two contact arms extending in a defmed direction substantially transverse to the contact member and leading to a pair of arrestor contacts, and the arrestor contacts being spaced apart sufficiently so as to accommodate a surge arrestor having endcaps, wherein each of the endcaps contacts said arrestor contacts.

2. An electrical terminal according to claim 1 wherein the contact members are parallel to each other within the electrical terminal.

3. An electrical terminal according to claim 1, wherein the surge arrestor is a barrel-type surge arrestor.

4. An electrical terminal according to claim 1 wherein the arrestor contacts comprise spring contacts.

5. An electrical terminal according to claim 4 wherein the contact arms end at the spring contacts.

6. An electrical terminal according to claim 1 wherein the contact arms are non-unitary with the contact members but are joined thereto.

7. An electrical terminal according to claim 6 wherein the join is by way of a lug extending from an edge of one of the two contact members and engaging within a slot of the other member.

8. An electrical terminal according to claim 1 wherein the terminal is enclosed within a plastic housing.

9. An electrical terminal according to claim 8 wherein the housing comprises a recess for receiving the surge arrestor, the arrestor contacts extending into the recess.

10. A linear array of electrical terminals, each of said electrical terminals being as set forth in claim 1.

11. A linear array of electrical terminals according to claim 10, including an earth strip and a plurality of earth contacts, the earth contacts extending from the earth strip into the recesses of the plastic housing.

12. An electrical terminal, comprising a pair of longitudinally disposed contact members, each having a pair of insulation displacement connectors, one at either end thereof, thereby to link two wire pairs, wherein each contact member includes a contact arm extending in a defined direction and leading to a pair of arrestor contacts spaced so as to accept a surge arrestor having endcaps, wherein each of the endcaps contacts said arrestor contacts, the contact arms being non-unitary with the contact members but joined thereto.

13. A cross-connect type electrical terminal for linking together two wire pairs, comprising a pair of contact members each having insulation displacement connectors at either end thereof, thereby enabling the two wire pairs to be linked, wherein each contact member of said pair of contact members includes a contact arm, the contact arms extending in a defined direction substantially transverse to the contact member and leading to a pair of arrestor contacts, the arrestor contacts being spaced apart sufficiently so as to accept a surge arrestor having endcaps, wherein each of the endcaps contacts said arrestor contacts.

* * * * *

UNITED STATES PATENT AND TRADEMARK OFFICE

CERTIFICATE OF CORRECTION

PATENT NO. : 6,193,556 B1
DATED : February 27, 2001
INVENTOR(S) : Richard Escane It is certified that error appears in the above-identified patent and that said Letters Patent is hereby corrected as shown below:

Title page,
ABSTRACT,
Line 3, replace, "displacement connectors" with -- displacement connector --;
Line 5, replace, "wherein. each" with -- wherein each --;

Column 1,
Line 14, replace, "Patent applications Nos." with -- Patent Applications numbers --;
Line 32, replace, "displacement connectors" with -- displacement connectors of the terminal. --;

Column 3,
Line 27, replace, "application No." with -- Application No. --;

Column 4, claim 1,
Line 3, replace, "defmed" with -- defined --;

Signed and Sealed this

Twenty-sixth Day of March, 2002

*Attest:*

*Attesting Officer*

JAMES E. ROGAN
*Director of the United States Patent and Trademark Office*